US005524365A

United States Patent [19]

Goldenberg

[11] Patent Number: 5,524,365

[45] Date of Patent: Jun. 11, 1996

[54] SHOE WITH EXCHANGEABLE HEEL

[76] Inventor: Tzvika Y. Goldenberg, 15720 Nursery Dr., Minnetonka, Minn. 55345

[21] Appl. No.: 291,423

[22] Filed: Aug. 16, 1994

[51] Int. Cl.[6] ..... A43B 21/36

[52] U.S. Cl. ..... 36/42; 36/36 C

[58] Field of Search ..... 36/42, 41, 36 R, 36/36 A, 36 B, 36 C

[56] References Cited

U.S. PATENT DOCUMENTS

| | | | |
|---|---|---|---|
| 181,109 | 8/1876 | Schwerdtfeger | 36/36 R |
| 1,516,355 | 11/1924 | Swetzoff | 36/42 |
| 1,604,826 | 10/1926 | Hornicek . | |
| 2,139,885 | 12/1938 | De Gironimo | 36/42 |
| 2,224,476 | 10/1940 | Farina | 36/42 |
| 2,439,310 | 4/1948 | Mancuso | 36/42 |
| 2,707,341 | 5/1955 | Romano . | |
| 2,767,489 | 10/1956 | Sturman | 36/42 |
| 2,852,866 | 9/1958 | Quirk . | |
| 2,943,404 | 7/1960 | Sultan . | |
| 3,266,177 | 8/1966 | Holden . | |
| 3,782,010 | 1/1974 | Frattallone | 36/42 |
| 3,805,418 | 4/1974 | Matuka et al. . | |
| 4,198,770 | 4/1980 | Orea Mateo | 36/42 |
| 4,219,946 | 9/1980 | Baum | 36/42 |
| 4,400,893 | 8/1983 | Musci | 36/42 |
| 4,443,956 | 4/1984 | Caccavale . | |
| 4,670,996 | 6/1987 | Dill | 36/42 |
| 4,805,320 | 2/1989 | Goldenberg et al. . | |
| 5,079,857 | 1/1992 | Clifton . | |
| 5,133,138 | 7/1992 | Durcho . | |
| 5,309,651 | 5/1994 | Handel . | |

FOREIGN PATENT DOCUMENTS

| | | | |
|---|---|---|---|
| 779863 | 6/1972 | Belgium . | |
| 1144929 | 10/1957 | France | 36/42 |
| 1409019 | 7/1965 | France . | |
| 1411974 | 8/1965 | France | 36/42 |
| 1580509 | 9/1969 | France . | |
| 2613598 | 10/1988 | France . | |
| 189779 | 10/1907 | Germany | 36/42 |
| 513172 | 3/1930 | Germany | 36/42 |
| 7210501 | 1/1984 | Taiwan . | |
| 713290 | 8/1954 | United Kingdom . | |
| 8806010 | 8/1988 | WIPO | 36/42 |

*Primary Examiner*—Paul T. Sewell
*Assistant Examiner*—Ted Kavanaugh
*Attorney, Agent, or Firm*—Peterson, Wicks, Nemer & Kamrath

[57] ABSTRACT

A shoe (10) is disclosed including a pin member (18) projecting outwardly from a head portion (20) secured to the sole (12) by a screw (256) extending through a bore (254) and threaded in a nut (252) imbedded in the head portion (20), with the bore (254) and the screw (256) being preferably at an obtuse angle to the pin member (18). An exchangeable heel (16) includes a preassembled capsule lock (200) secured in a bore (24). The capsule lock (200) includes a housing formed by a bottom cup (202) being press fit in a top insert (222). A washer member (214) of a lock member (50) is biased against the lower surface of a plate (230) integrally formed in the cylindrical portion (224) of the top insert (222) by a compression spring (48), with the plate (230) being at an acute angle to the axis of the housing and to the pin member (18). The head portion (20) terminates in a lower cylindrical portion (240) having an abutment surface (242) which flushly abuts with the upper surface of the plate (230) when the lower cylindrical portion (240) is slideably fit in a socket formed in the housing. Alignment ears (250, 264) are also slideably fit within troughs (248, 268) when the head portion (20) is slideably fit within a recess (22) formed in the heel (16).

39 Claims, 2 Drawing Sheets

SHOE WITH EXCHANGEABLE HEEL

BACKGROUND

This invention relates generally to footwear, and more particularly to the construction of a shoe where the entire heel or a portion thereof may be readily removed and exchanged with a heel or a heel portion having differing style, color, height, width or other characteristics.

In the field of footwear, and especially women's shoes, a need has been recognized for a more economical way to match the footwear to the woman's wardrobe than having one or more pairs of shoes for each suit, dress or casual outfit that a person may own. Obtaining and maintaining a collection of shoes to meet varying occasions can be quite expensive.

Since, to a large extent, the size, shape and color of a shoe's heel has a substantial impact on its overall appearance and comfort, the ability to readily remove and exchange the heel portion of the shoe has been further recognized as a manner which could meet the need to economically match footwear to the wardrobe. Specifically, it is not necessary to acquire a large inventory of pairs of shoes but, instead, the desired "look" and/or comfort factor can be achieved by merely substituting a new heel at a significantly lower cost. U.S. Pat. No. 4,805,320 is believed to show preferred manners of substituting heels.

However, further need exists to improve the construction of exchangeable heels such as shown in U.S. Pat. No. 4,805,320. Specifically, exchangeable heels of U.S. Pat. No. 4,805,320 are somewhat difficult to manufacture as several small pieces are required to be assembled to the core piece of the heel. Likewise, the need exists to continue to improve the feel to the wearer that the heel is an integral component of the shoe, with some relative movement in prior exchangeable heel shoes being allowed due to loose tolerances in manufacture or as the result of wear. Similarly, the securement means to the sole of the shoe may tend to tilt relative to the sole due to differences in direction of force transfer from the heel to the pin and head portion causing discomfort to the wearer.

SUMMARY

The present invention solves these needs and other problems in the field of exchangeable heel shoes by providing, in the most preferred form, a capsule lock including a washer member of a lock member biased against the lower surface of a plate located in the interior of a housing and extending at an acute angle, with the aperture of the washer member having a size allowing the pin member of the upper to pass through the aperture when the aperture is aligned with the pin member and binding on the pin member when the aperture is not aligned with the pin member, and with the housing being securable in one of the upper or the heel of the shoe.

In further aspects of the present invention, the head portion includes an abutment surface which extends at an acute angle relative to the pin member and which flushly abuts with an upper surface of a socket formed to slideably receive the head portion.

In another aspect of the present invention, at least a first trough for the slideable fit of an alignment ear is formed in one (or-both) of the head portion and the recess which slideably receives the head portion.

In another aspect of the present invention, a nut is embedded in the head portion and a bore extends from the nut to the upper surface of the head portion for receiving a screw for threadable receipt in the nut, with the pin member projecting outwardly from the head portion in a direction which is at an obtuse angle to the bore.

It is accordingly a principal object of the present invention to provide an improved shoe construction wherein the heel or a portion thereof can be readily removed and replaced to effect a style change in the sole.

Another object of the invention is to provide a shoe construction in which the style, color, and other characteristics can readily be altered.

Still another object of the invention is to provide in a shoe the ability to remove and replace the heel thereof in a matter of seconds and without the use of special tools.

It is further an object of the present invention to provide such a novel shoe which is easy to manufacture.

It is further an object of the present invention to provide such a novel shoe including a capsule lock including all of the operative parts of the heel which can be preassembled separate from the heel.

It is further an object of the present invention to provide such a novel shoe providing added comfort to the wearer.

It is further an object of the present invention to provide such a novel shoe giving the wearer further feelings of assurance that the heel will not separate from or move relative to the sole of the upper.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
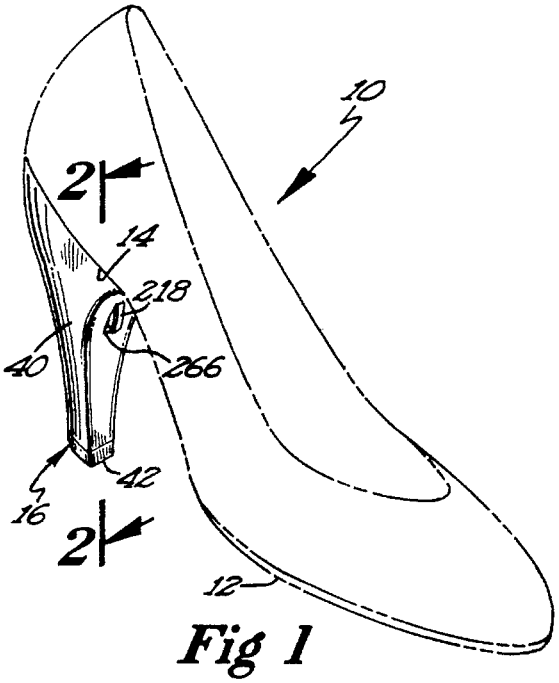
FIG. 1 shows a perspective view of a shoe according to the preferred teachings of the present invention.

The figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the figures of the drawings, the same numerals designate the same or similar parts. Furthermore, when the terms "first", "second", "radial", "axial", "upper", "lower", and similar terms are used herein, it should be understood that these terms have reference only to the structure shown in the drawings as it would appear to a person viewing the drawings and are utilized only to facilitate describing the invention.

DESCRIPTION

A shoe according to the preferred teachings of the present invention is shown in the drawings in the preferred form and is generally designated 10. In the most preferred embodiments of the present invention, shoe 10 is an improvement of the type shown and described in U.S. Pat. No. 4,805,320. For purpose of explanation of the basic teachings of the present invention, the same numerals designate the same or similar parts in the present figures and the figures of U.S. Pat. No. 4,805,320. The description of the common numerals and shoe 10 may be found herein and in U.S. Pat. No. 4,805,320, which is hereby incorporated herein by reference.

Referring to the drawings in detail, shoe 10 generally includes a sole 12 having a surface 14 to which the shoe heel 16 is to be fastened. Suitably affixed to surface 14 of shoe 10 is a pin assembly including a shaft or pin member 18 extending outwardly from a head portion 20, with pin member 18 being cylindrical in the most preferred form.

A typical shoe heel 16 includes a molded plastic core piece 38 which is covered on its exterior surfaces with leather, patent leather or a suitable natural or synthetic fabric, here identified by numeral 40. At the bottom of the heel 16 is a rubber, plastic, steel or leather layer 42 comprising the heel pad.

To releasably lock heel 16 in place and to avoid inadvertent loss of heel 16 when being worn, shoe 10 of the present invention includes a latch mechanism which must be manipulated by hand to achieve release of heel 16 of shoe 10 from the upper. In the most preferred form, the latch mechanism is in the form of a capsule lock 200 which is assembled as a single component into core piece 38 in the most preferred form. Specifically, lock 200 generally includes a bottom cup 202 having a first cylindrical portion 204 including a closed bottom and an open top. Cylindrical portion 204 has a diameter slightly larger than the diameter of pin member 18. Cup 202 further includes an annular portion 206 integrally extending generally radially and perpendicularly from the open top of cylindrical portion 204. In the most preferred form, annular portion 206 has generally L-shaped cross sections and includes a first, axially extending portion 207 extending from the open top of cylindrical portion 204 towards but substantially spaced from the bottom of cylindrical portion 204 and having rectangular cross sections. Portion 206 further includes a second portion 208 extending radially outwardly from the outer surface of portion 204 and having rectangular cross sections, with portion 208 having an upper surface 209. In the most preferred form, an axially extending positioning boss 210 is integrally formed and extends radially outwardly of the outer surface of portion 204 to the same extent as radially extending portion 208 from portion 204, with boss 210 extending from the bottom to the top of portion 204.

Capsule lock 200 further includes a compression spring 48 of a size for receipt in portion 204 and for receiving pin member 18, with compression spring 48 having a length at least greater than the height of portion 204 in the most preferred form. Capsule lock 200 also includes in the most preferred form a plurality of washers 212 having apertures therethrough greater in diameter and for receiving pin member 18, with three washers 212 being provided in the most preferred form. Washers 212 in the most preferred form have circular outer peripheries having an outer diameter greater than the diameter of portion 204.

Capsule lock 200 according to the preferred teachings of the present invention includes a lock member 50 which is preferably formed from spring steel. Specifically, lock member 50 includes a flat, annular or washer member 214. Washer member 214 in the most preferred form has a circular outer periphery having an outer diameter greater than the diameter of portion 204 and in the most preferred form generally equal to the outer diameter of washers 212. Washer member 214 has an aperture therethrough just slightly greater in diameter than the outside diameter of pin member 18. Lock member 50 further includes a flat, neck member 216 integrally extending radially from the outer diameter of washer member 214 and in the same plane as washer member 2,14. Lock member 50 further includes a handle 218 integrally extending generally axially downwardly from the outer end of neck 216, with the axial length of handle 218 being greater than the axial height of portion 204.

Capsule lock 200 according to the preferred teachings of the present invention further includes a top insert 222. In the most preferred form, insert 222 includes a tubular portion 224 which is cylindrical in the most preferred form and having an outer diameter generally equal to that of radially extending portion 208. The diameter of the inside surface of cylindrical portion 224 in the most preferred form is generally equal to the diameter of the outer surface of cylindrical portion 204 and is larger than the outer diameter of washers 212 and washer member 214. An annular recess 226 is formed in the inside surface of cylindrical portion 224 extending from the bottom thereof of a size complementary to and for press fitting with axially extending portion 207. A notch 228 is formed in the bottom of cylindrical portion 224 of a size for slideable receipt of the portion of boss 210 positioned above upper surface 209 of bottom cup 202. It can then be appreciated that with axially extending portion 207 press fit in recess 226 and boss 210 received in notch 228, the bottom of cylindrical portion 224 flushly abuts with upper surface 209. A washer shaped plate 230 having parallel upper and lower surfaces is integrally positioned in the inside surface of cylindrical portion 224 and extends at an acute angle in the order of 75° relative to the axis of cylindrical portion 224. The bore 232 of washer-shaped plate 230 extends parallel to the axis of cylindrical portion 224. A slot 234 extends axially from the bottom of cylindrical portion 224 to the lower surface of plate 230 at its outer periphery at the greatest spacing from the bottom of cylindrical portion 224. The width of slot 234 is slightly greater than the width of and for axially slideably receiving neck member 216 of lock member 50. In the most preferred form, notch 228 and boss 210 received therein are circumferentially spaced generally 90° from slot 234.

In an assembled relation, top insert 222 is slideably received on bottom cup 202 and specifically portion 207 is press fit in recess 226, boss 210 is received in notch 228, and upper surface 209 of portion 204 abuts with the lower surface of portion 224 to form a housing defining an interior. Although press fit on bottom cup 202 in the most preferred form, insert 222 can be suitably secured to bottom cup. 202 by any suitable technique such as but not limited to an adhesive or the like. It can be appreciated that the receipt of boss 210 in notch 228 provides a unique orientation of top insert 222 relative to bottom cup 202. Washers 212 and washer member 214 of lock member 50 are located in the interior of the housing and are sandwiched between the lower surface of plate 230 and spring 48. It can be appreciated that due to the flexibility of spring 48, spring 48 biases washer member 214 to flushly abut with and be parallel to the lower surface of plate 230. Washers 212 are parallel to washer member 214 and plate 230 and are positioned intermediate spring 48 and washer member 214. Due to the angle of the lower surface of plate 230, washer member 214 is out of perpendicular alignment with the inside surface and axis of cylindrical portion 224 When flushly abutting with surface 232. However, by manipulation of handle 218 of lock member 50, washer member 214 can be pivoted about plate 230 at its minimum axial thickness diametrically opposite to slot 234 and relative to the lower surface of plate 230 such that washer member 214 can be brought into perpendicular alignment with the inside surface and axis of cylindrical portion 224.

In the most preferred form, head portion 20 of the pin assembly includes a lower cylindrical portion 240 of a diameter greater than pin member 18 and generally equal to and for slideable receipt in the exterior socket of the housing of capsule lock 200 formed and defined by the inside surface of cylindrical portion 224 and the upper surface of plate 230. Portion 240 is generally concentric to pin member 18 and includes a flat, lower, abutment surface 242 extending at an acute angle relative to pin member 18 corresponding to the angle of the upper surface of plate 230 relative to the inside surface and axis of cylindrical portion 224. The upper surface of portion 240 is integrally secured to the lower surface of an upper portion including a frustoconical section 244 which is generally concentric to pin member 18. The upper surface of section 244 is integrally secured to the lower surface of an enlarged section 246 having non-circular cross sections, with the upper and lower surfaces of enlarged section 246 being parallel and spaced and at a non-perpendicular angle to pin member 18.

Figure 3:
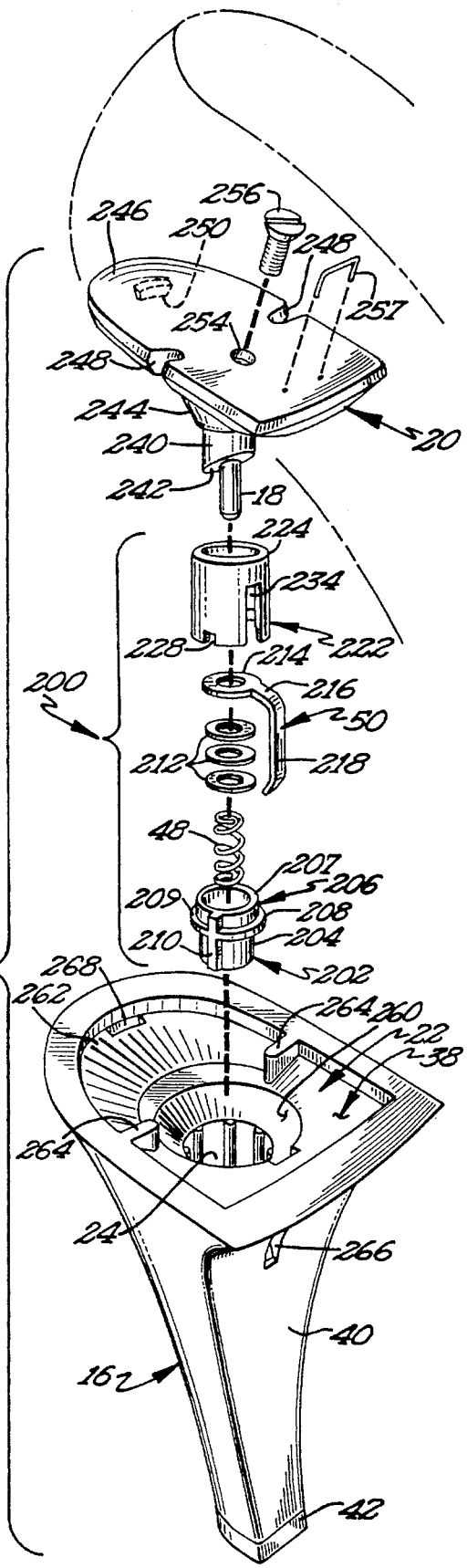
FIG. 3 shows a partial, exploded perspective view of the shoe of FIG. 1.
Figure 2:
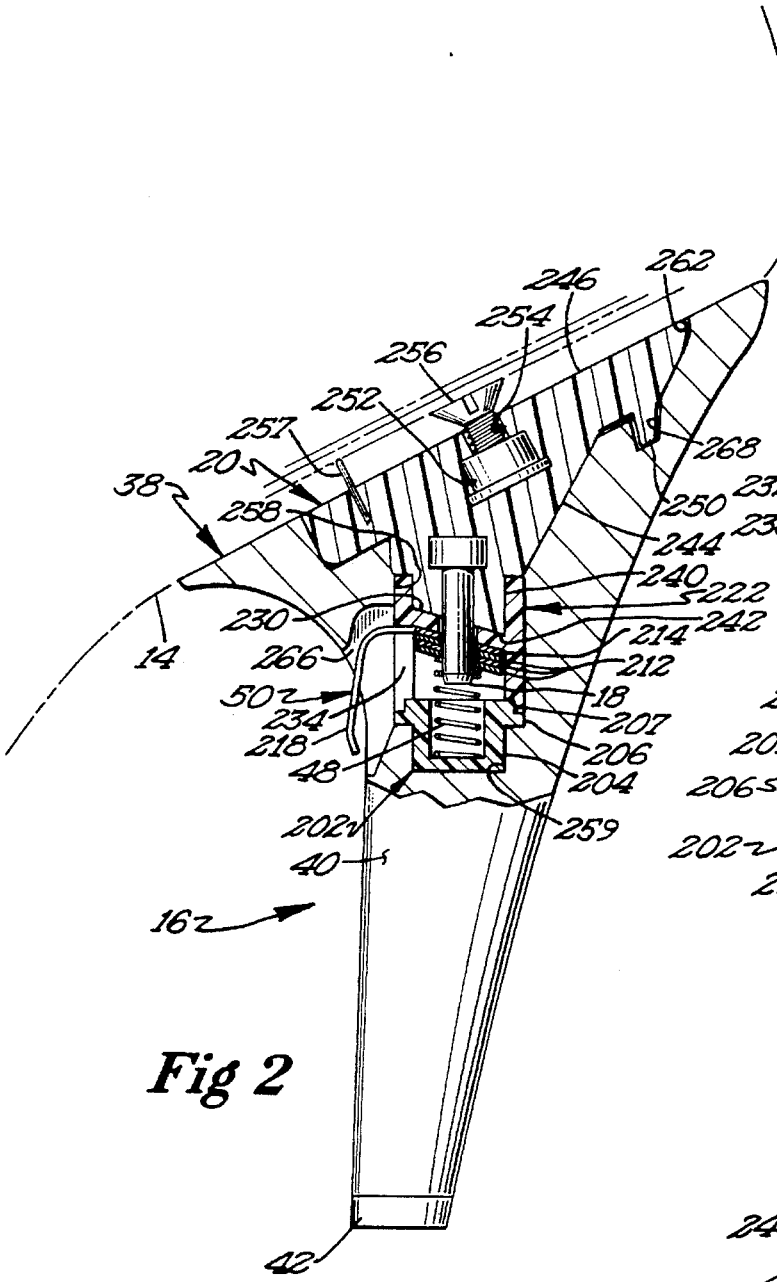
FIG. 2 shows a partial, cross-sectional view of the shoe of FIG. 1 according to section line 2—2 of FIG. 1.
Figure 5:
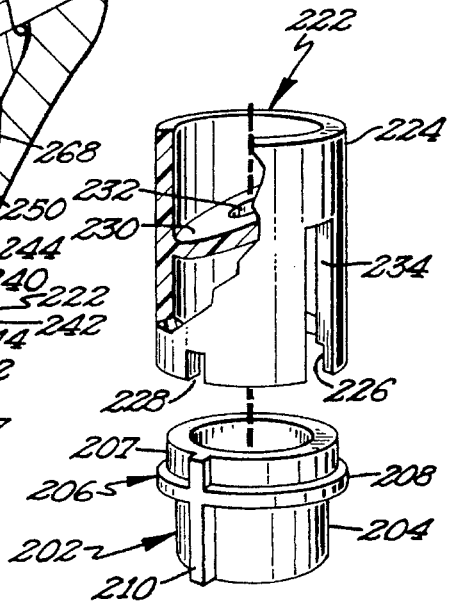
FIG. 5 shows an exploded, perspective view of the housing components of the capsule lock of the shoe of FIG. 1, with portions broken away to show constructional details.
Figure 4:
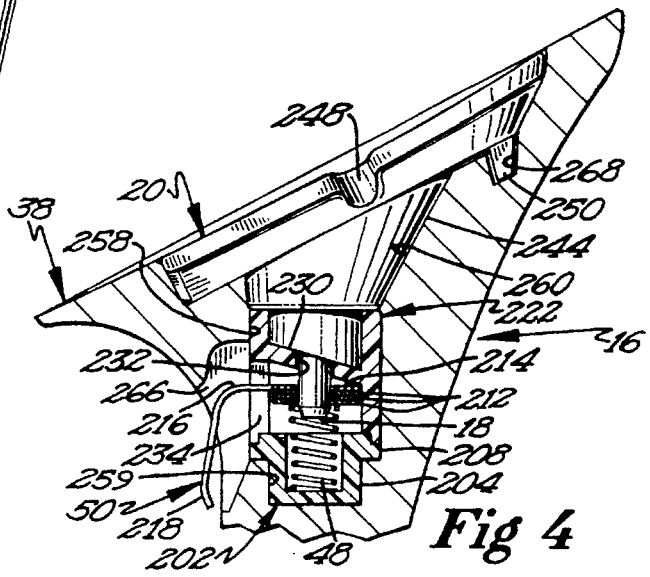
FIG. 4 shows a partial, cross-sectional view of the shoe of FIG. 1 with the lock member in the release condition.

In the preferred form as shown in FIGS. 3 and 4, enlarged section 246 of head portion 20 includes first and second troughs 248 formed in the sides thereof, with pin member 18 located intermediate and parallel to first and second troughs 248. In the most preferred form, troughs 248 have a depth from the peripheral sides of section 246 generally coextensive with section 244 at its upper surface. In the most preferred form, troughs 248 generally include a first portion defined by parallel, side walls parallel to the axis of pin member 18 and a second portion defined by an arcuate side wall extending from and between the parallel side walls of the first portion. In the preferred form as shown in FIGS. 2–4, enlarged section 246 of head portion 20 further includes an arcuate-shaped alignment ear 250 located behind and spaced from the axis of pin member 18.

Pin member 18 and head portion 20 can be firmly and rigidly secured to each other and/or surface 14 of sole 12 by any suitable technique including but not limited to the manners as shown in U.S. Pat. No. 4,805,320. In the most preferred form as shown in FIGS. 2 and 3, a nut 252 is generally embedded in section 246 spaced from the upper surface thereof and of head portion 20. A bore 254 extends from nut 252 to the upper surface of section 246 concentric to the rotation axis of the threads of nut 252 and is of a size for slideably receiving a screw 256 which is threaded in nut 252. The head of screw 256 can be countersunk in the layer overlain by the insole lining, with screw 256 extending through the further layers of sole 14 underlaying the layer in which the head of screw 256 is countersunk. In the most preferred form, bore 254 is at an obtuse angle in the order of 150° from pin member 18 such that the head of screw 256 does not have a tendency to tilt relative to sole 14 and cause discomfort to the bottom of the wearer's foot which can occur if pin member 18 and screw 256 are axially in line and especially if formed as a single piece. To prevent undesired rotation of head portion 20 about screw 256, suitable provisions such as a staple 257 can be provided, with staple 257 extending through the layers of sole 12 overlain by the insole lining and into head portion 20.

Heel 16, from the standpoint of external appearance, is quite conventional and would be shaped to conform with the style of the shoe's upper. However, formed in the upper portion of core piece 38 and internally of heel 16 is a recess 22 having the same shape profile of sections 244 and 246 of head portion 20 affixed to the shoe upper. Extending downwardly from the base of the recess 22 is a bore 24 whose diameter is greater than the diameter of the pin 18 and of a size for receipt of capsule lock 200. In particular, bore 24 includes a lower, cylindrical portion 259 having a size and shape for receipt of portion 204 and an upper, cylindrical portion 258 having a size and shape for slideable receipt of portion 208 of bottom cup 202 and top insert 222. In the most preferred form, capsule lock 200 is suitably retained in bore 24 by any suitable means including but not limited to core piece 38 being formed around capsule lock 200, friction fit, adhesive, ratchet type barbs allowing entry but generally preventing removal, or the like. It can be appreciated that boss 210 provides a unique orientation of capsule lock 200 in heel 16 and prevents relative rotation of capsule lock 200 in heel 16 due to the non-symmetrical shape of the housing of capsule lock 200 provided thereby. Recess 22 includes a portion 260 of a size and shape for slideable receipt of section 244. Recess 22 further includes an upper portion 262 of a size and shape for slideable receipt of section 246.

According to the preferred teachings of the present invention, capsule locks 200 are preassembled as a separate unit or component from core piece 38 and covering 40. It can then be appreciated that capsule lock 200 can be of a standard size for shoes 10 of differing varieties and styles, thus reducing inventory requirements. Further, the complexity of the molds for forming core pieces 38 is greatly reduced as intricate passage and recesses are not required. Additionally, capsule lock 200 can be easily assembled by simply dropping spring 48 into bottom cup 202, and dropping washers 212 and lock member 50 into top insert 222 and then assembling bottom cup 202 and top insert 222. In particular, it is not required to retain a small diameter spring in a first bore by inserting a lock member 50 in a lateral slot formed in the heel in a manner as required in the shoe of U.S. Pat. No. 4,805,320.

Extending upwardly from the base of upper portion 262 of recess 22 and integrally formed with the side walls of portion 262 are first and second alignment ears 264 of a size and shape corresponding to and for slideable receipt in troughs 248 of head portion 20. The dimensions of ears 264 are such that they fit within troughs 248 in a predetermined clearance fit. A trough 268 is also formed in portion 262 in the most preferred form for slideable receipt of alignment ear 250 in a predetermined clearance fit. Also, the dimensions of recess 22 are such that head portion 20 fits therein in a predetermined clearance fit.

A passage 266 extends from the outer surface of heel 16 generally coextensive with capsule lock 200 for receipt of neck member 216 positioned outside of top insert 222 and handle 218 and allowing movement of lock member 50 according to the teachings of the present invention. In the most preferred form, a jacket or similar cover, not shown, is provided to cover handle 218 in passage 266 to prevent or limit the likelihood of handle 218 piercing covering 40.

Now that the basic construction of shoe 10 according to the preferred teachings of the present invention has been explained, the operation and subtle features of shoe 10 can be set forth and appreciated. Specifically, for the sake of explanation, it will be assumed that heel 16 has been separated from the upper of shoe 10. After the desired heel 16 has been selected to match the particular outfit of the wearer, heel 16 is aligned with pin member 18 and head portion 20. At that time, heel 16 is moved parallel to the axis of the housing defined by bottom cup 202 and top insert 222 to pass through aperture 232 of plate 230, the apertures of washer member 214 and washers 212, and into spring 48. It can be appreciated that washer member 214 will move against the bias of spring 48 to be in perpendicular alignment with pin member 18 to allow pin member 18 to pass through the aperture of washer member 214. When head portion 20 is slideably fit within and abuts with recess 22, further movement of heel 16 is prevented in the insertion direction. Additionally, movement of heel 16 in the opposite direction is also prevented since washer member 214 will bind upon pin member 18 if pin member 18 is attempted to be withdrawn from washer member 214 (and assuming that lock member 50 is not manually manipulated to be perpendicular to pin member 18). It can then be appreciated that with pin member 18 held by capsule lock 200 and with head portion 20 slideably fitted in recess 22, heel 16 is accurately and firmly secured to surface 14 of sole 12.

In the event that heel 16 is desired to be exchanged for example with heel 16 of a differing style, color, height, width, or other characteristic, handle 218 is manually manipulated to place washer member 214 to be perpendicular to pin member 18 and allowing pin member 18 to be withdrawn and pass through the aperture of washer member 214 in a direction opposite to the insertion direction and parallel to the axis of the housing of capsule lock 200. Thus heel 16 can be removed from sole 12. A different heel 16 can then be selected and secured to sole 12 according to the teachings of the present invention.

Shoe 10 according to the preferred teachings of the present invention improves the comfort of the wearer of shoe 10. Specifically, in addition to preventing screw 256 from digging into the bottom of the foot of the wearer as set forth previously, the relationship of heel 16 and head portion 20 improves the feel to the wearer that heel 16 is an integral component of shoe 10. In particular and in addition to the slideable, clearance fit of head portion 20 into recess 22, the acute angle of the abutment surface 242 of cylindrical portion 240 of head portion 20 and of-the upper surface of plate 230 of the socket formed in capsule lock 200 relative to pin member 18 as best seen in FIGS. 2 and 4 tends to prevent relative rotation and other relative movement of heel 16 and head portion 20 about pin member 18. Further, the receipt of alignment ears 250 and 264 in troughs 268 and 248, respectively, tends to prevent relative rotation and other relative movement of heel 16 and head portion 20 about pin member 18. Further, alignment ears 250 and 264 received in troughs 268 and 248 provide additional support for preventing heel 16 from pivoting about axes perpendicular to pin member 18 and thus from tilting relative to sole 12. Thus, added comfort to the wearer is obtained with shoe 10 according to the preferred teachings of the present invention.

Now that the basic construction of shoe 10 according to the preferred teachings of the present invention has been explained, many extensions and variations will be obvious to one having ordinary skill in the art. For example, although shoe 10 in the most preferred form includes several unique and novel features combined in a manner believed to produce synergistic results, shoe 10 can be constructed utilizing such features independently or in other combinations according to the teachings of the present invention.

Likewise, although pin member 18 and head portion 20 are secured to the upper and capsule lock 200 is secured to heel 16 in the most preferred form, it can be appreciated that reversal of these components may be possible according to the teachings of the present invention.

Likewise, the particular shapes of various components, including but not limited to pin member 18, head portion 20, capsule lock 200, washers 212, washer member 214, alignment ears 250 and 264, troughs 248 and 268, and the like, have been shown and described in the most preferred form of shoe 10 according to the preferred teachings of the present invention. However, it can be further appreciated that other shapes may be utilized according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Capsule lock comprising, in combination: a rigid pin member; a housing defining an interior and having an axis, with the housing including a housing aperture allowing the pin member to pass therethrough into the interior; a lock member including a washer member having a washer aperture therethrough, with the washer aperture of the washer member having a size allowing the pin member to pass through the washer aperture when the washer aperture is aligned with said pin member and binding on the pin member when the washer aperture is out of alignment with said pin member, with the washer being of a size for receipt in the interior of the housing, with the interior of the housing including a lower surface against which the washer abuts; and means located in the interior of the housing for biasing the washer member against the lower surface, with the aperture of the washer member being out of alignment with said pin member when the washer member abuts with the lower surface, with the lock member further including means for moving the washer member relative to the lower surface against the bias of the biasing means.

2. The capsule lock of claim 1 wherein the housing includes a plate having the lower surface extending at an acute angle relative to the axis of the housing, with the plate including the housing aperture.

3. The capsule lock of claim 2 wherein the washer member flushly abuts with the lower surface.

4. The capsule lock of claim 2 wherein the plate has an upper surface located outside of the interior, with the housing and the upper surface defining an exterior socket; and wherein the capsule lock further comprises, in combination: a head portion having a lower portion of a size and shape for slideable receipt in the exterior socket, with the lower portion having an abutment surface for abutting with the upper surface, with the pin member projecting outwardly from the lower portion.

5. The capsule lock of claim 4 wherein the exterior socket and the lower portion of the head portion are cylindrical shaped.

6. The capsule lock of claim 4 wherein the upper surface and the abutment surface extends at an acute angle relative to the axis of the housing.

7. The capsule lock of claim 1 wherein the moving means comprises, in combination: a slot formed in the housing providing access to the interior; and a handle located outside of the interior and including a neck extending through the slot and secured to the washer member.

8. The capsule lock of claim 7 wherein the housing includes a positioning boss for use in orientating the housing.

9. The capsule lock of claim 8 wherein the housing includes a bottom cup axially spaced from the lower surface; and wherein the biasing means comprises a compression spring of a size for receipt in the bottom cup and for receiving the pin member.

10. The capsule lock of claim 9 wherein the housing includes a top insert having a tubular portion having an inside surface, with the lower surface positioned in the inside surface of the tubular portion; and wherein the bottom cup is press fit with the tubular portion to form the housing.

11. The capsule lock of claim 10 wherein the top insert includes means for orientating the tubular portion relative to the bottom cup.

12. The capsule lock of claim 1 further comprising in combination: a head portion, with the head portion including an upper surface; and wherein the head portion further includes an embedded nut spaced from the upper surface and a bore extending from the nut to the upper surface, with the bore of the head portion receiving a screw for threadable receipt in the nut, with the pin member projecting outwardly from the head portion in a direction which is at an obtuse angle to the bore of the head portion.

13. The capsule lock of claim 12 further comprising, in combination: means for preventing relative rotation of the head portion about the screw received the bore of the head portion.

14. The capsule lock of claim 13 wherein the preventing means comprises, in combination: a staple extending into the head portion.

15. The capsule lock of claim 1 wherein the washer aperture is perpendicular to the pin member when aligned with the pin member.

16. The capsule lock of claim 1 further comprising, in combination: a head portion having a lower portion, with the pin member projecting outwardly from the lower portion, with the housing including an exterior socket of a size and shape for slideably receiving the lower portion.

17. The capsule lock of claim 16 wherein the exterior socket and the lower portion of the head portion are cylindrical shaped.

18. The capsule lock of claim 16 wherein the housing includes an upper surface; and wherein the lower portion includes an abutment surface for abutting with the upper surface when the lower portion is slideably received in the exterior socket.

19. The capsule lock of claim 1 wherein the biasing means comprises a compression spring of a size for receipt in the interior of the housing and for receiving the pin member.

20. The capsule lock of claim 1 wherein the housing includes a top insert having the lower surface and including a button cup separately formed from the top insert, with the lock member and the biasing means being insertable into the interior of the housing when the top insert and the bottom cup are separated and being captured in the interior of the housing when the top insert and the bottom cup are secured together to form the housing.

21. The capsule lock of claim 20 wherein the lock member and the biasing means are insertable into the bottom cup when the top insert and the bottom cup are separated.

22. The capsule lock of claim 20 wherein the housing includes means for orientating-the top insert relative to the bottom cup.

23. The capsule lock of claim 1 wherein the housing includes a positioning boss for use in orientating the housing.

24. Shoe having a toe comprising, in combination: an upper having a head portion including an abutment surface; a heel including a socket having an upper surface and a bottom, with the socket being of a size and shape for slideably receiving the head portion with the upper surface flushly abutting with the abutment surface; a pin member secured to one of the head portion and the heel and projecting outwardly from the abutment surface at an acute angle relative to the abutment surface, with the upper surface having a minimum and a maximum axial thickness from the bottom of the heel, with the pin being intermediate the minimum axial thickness and the toe and the maximum axial thickness being intermediate the pin and the toe; a bore formed in the other of the head portion and the heel for receiving the pin member; and means for releasably locking the pin member within the bore.

25. The shoe of claim 24 wherein the head portion includes a lower cylindrical portion concentric to and of a diameter greater than the pin member, with the abutment surface forming an end of the lower cylindrical portion; and wherein the head portion further includes an upper portion of a non-cylindrical shape; and wherein the heel includes a recess of a size and shape for slideably receiving the upper portion.

26. The shoe of claim 25 further comprising, in combination: at least a first trough formed in one of the upper portion and the recess with the trough having side walls parallel to the axis of the pin member; and an alignment ear formed in the other of the upper portion and the recess for slideable fit into and out of the first trough, with the alignment ear being radially spaced from the lower cylindrical portion.

27. The shoe of claim 26 further comprising, in combination: a second trough, with the first trough being diametrically opposite to the second trough with the heel having sides, with the first and second troughs located adjacent the sides of the heel.

28. The silos of claim 27 further comprising, in combination: a third trough, with the pin member located intermediate the toe and the third trough.

29. The shoe of claim 25 wherein the upper portion includes a frustoconical section which is generally concentric to the pin member, with the lower cylindrical portion being directly secured to the frustoconical section.

30. The shoe of claim 29 wherein the upper portion includes an enlarged section having non-circular cross sections, with the frustoconical section located intermediate the lower cylindrical portion and the enlarged section.

31. Shoe comprising, in combination: an upper; a heel, having sides, with one of the upper and the heel having a head portion including peripheral sides; a recess formed in the other of the upper and the heel of a size and shape defined by a sidewall for slideably receiving the head portion with peripheral sides being slidably received in the sidewall, a projecting pin member; a bore for receiving the pin member; means for releasably locking the pin member within the bore; at least a first trough and a second trough formed in the peripheral sides of the upper portion and having a depth in the peripheral sides, with the first trough formed diametrically opposite to the second trough, with the first and second troughs located adjacent the sides of the heel; and a first alignment ear and a second alignment ear formed integral with the sidewall and extending into the recess for slideable fit into and out of the first and second troughs.

32. The shoe of claim 31 further comprising, in combination: a third trough formed on the recess behind the pin member, with the shoe having a toe; and a third alignment ear for slideable fit in the third trough and located opposite the first and second troughs than the toe of the shoe.

33. The shoe of claim 31 wherein the first and second troughs each have side walls parallel to the pin member.

34. Shoe comprising, in combination: an upper having a head portion including a lower cylindrical portion having a diameter and an abutment surface, with the abutment surface forming an end of the lower cylindrical portion; a heel including a socket having an upper surface, with the socket being of a size and shape for slideably receiving the head portion with the upper surface flushly abutting with the abutment surface; a pin member secured to one of the head portion and the heel and projecting outwardly from the abutment surface at an acute angle relative to the abutment surface, with the diameter of the lower cylindrical portion being greater than the pin member, with the lower cylindrical portion being concentric to the pin member; a bore formed in the other of the head portion and the heel for receiving the pin member; and means for releasably locking the pin member within the bore.

35. The shoe of claim 34 wherein the head portion further includes an upper portion of a non-cylindrical shape; and wherein the heel includes a recess of a size and shape for slideably receiving the upper portion.

36. The shoe of claim 35 wherein the upper portion includes a frustoconical section which is generally concentric to the pin member, with the lower cylindrical portion being directly secured to the frustoconical section.

37. The shoe of claim 36 wherein the upper portion includes an enlarged section having non-circular cross sections, with the frustoconical section located intermediate the lower cylindrical portion and the enlarged section.

38. The shoe of claim 35 further comprising, in combination: at least a first trough formed in one of the upper portion and the recess, with the trough having side walls parallel to the pin member; and an alignment ear formed in the other of the upper portion and the recess for slideable fit into and out of the first trough, with the alignment ear being radially spaced from the lower cylindrical portion.

39. The shoe of claim 38 further comprising, in combination: a second trough, with the first trough being diametrically opposite to the second trough, with the heel having sides, with the first and second troughs located adjacent the sides of the heel.

* * * * *